US005850673A

United States Patent [19]

Wood, Sr. et al.

[11] Patent Number: 5,850,673

[45] Date of Patent: Dec. 22, 1998

[54] CONSTANT CONTACT HINGE ASSEMBLY

[76] Inventors: Vincent Wood, Sr.; Vincent Wood, Jr., both of 4920 Kebbe Dr., Sterling Heights, Mich. 48310

[21] Appl. No.: 627,091

[22] Filed: Apr. 3, 1996

[51] Int. Cl.[6] ..... E05D 11/10

[52] U.S. Cl. ..... 16/334; 16/382

[58] Field of Search ..... 16/334–336, 261–264, 16/352, 353, 344, 345, 308, 382; 296/146.11, 146.12

[56] References Cited

U.S. PATENT DOCUMENTS

| | | | |
|---|---|---|---|
| 3,820,192 | 6/1974 | Nakano et al. | 16/334 |
| 3,969,789 | 7/1976 | Wize | 16/334 |
| 4,720,895 | 1/1988 | Peebles | 16/382 |
| 4,765,025 | 8/1988 | Salazar | 16/261 |
| 4,807,331 | 2/1989 | Calucci | 16/262 |
| 4,864,687 | 9/1989 | Calcaterra et al. | 16/237 |
| 4,932,101 | 6/1990 | Lualdi | 16/255 |
| 5,226,202 | 7/1993 | Griffins | 16/335 |
| 5,404,618 | 4/1995 | Heiler et al. | 16/261 |
| 5,444,894 | 8/1995 | Heiler | 16/262 |

*Primary Examiner*—Chuck Mah

*Attorney, Agent, or Firm*—Glifford, Krass, Groh, Sprinkle, Patmore, Anderson & Citkowski, P.C.

[57] ABSTRACT

An automobile door hinge which can be taken apart during vehicle production without removal of its hinge pin has a cam on one of its parts with a continuous surface to supply smooth detent action at closed, partially open and fully open positions. A cam follower for coaction with the cam is located adjacent a free end of a torsion spring attached to another of the hinge parts.

5 Claims, 2 Drawing Sheets

FIG-3
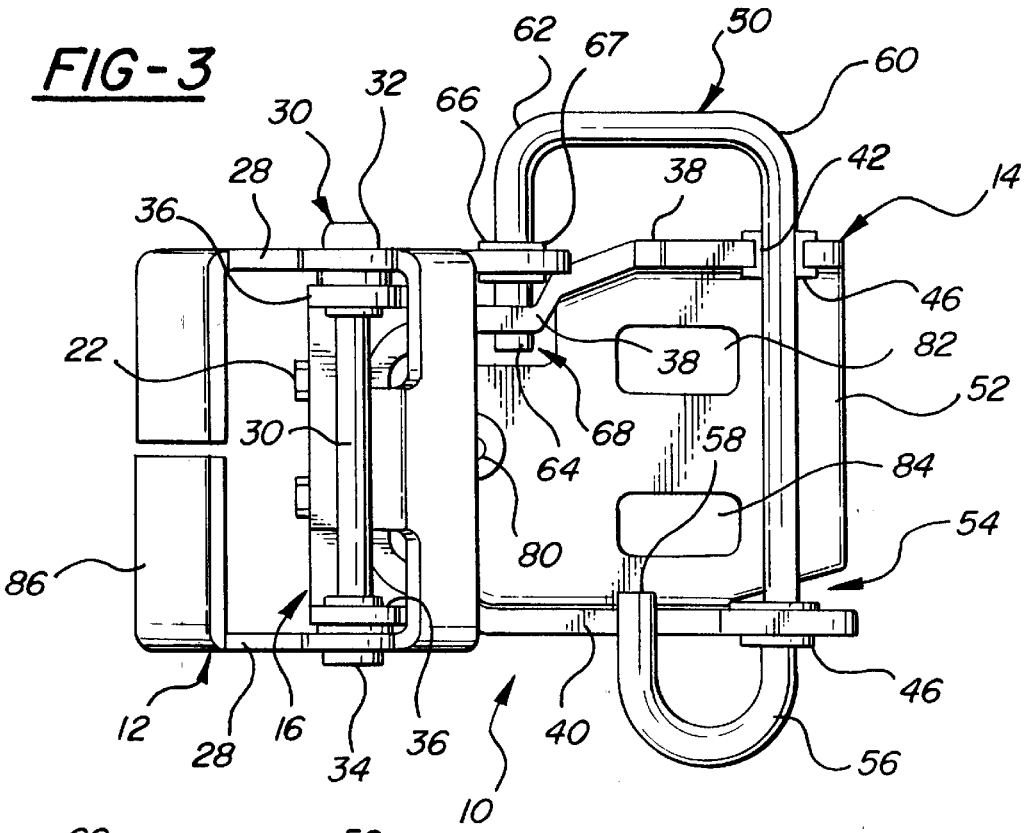
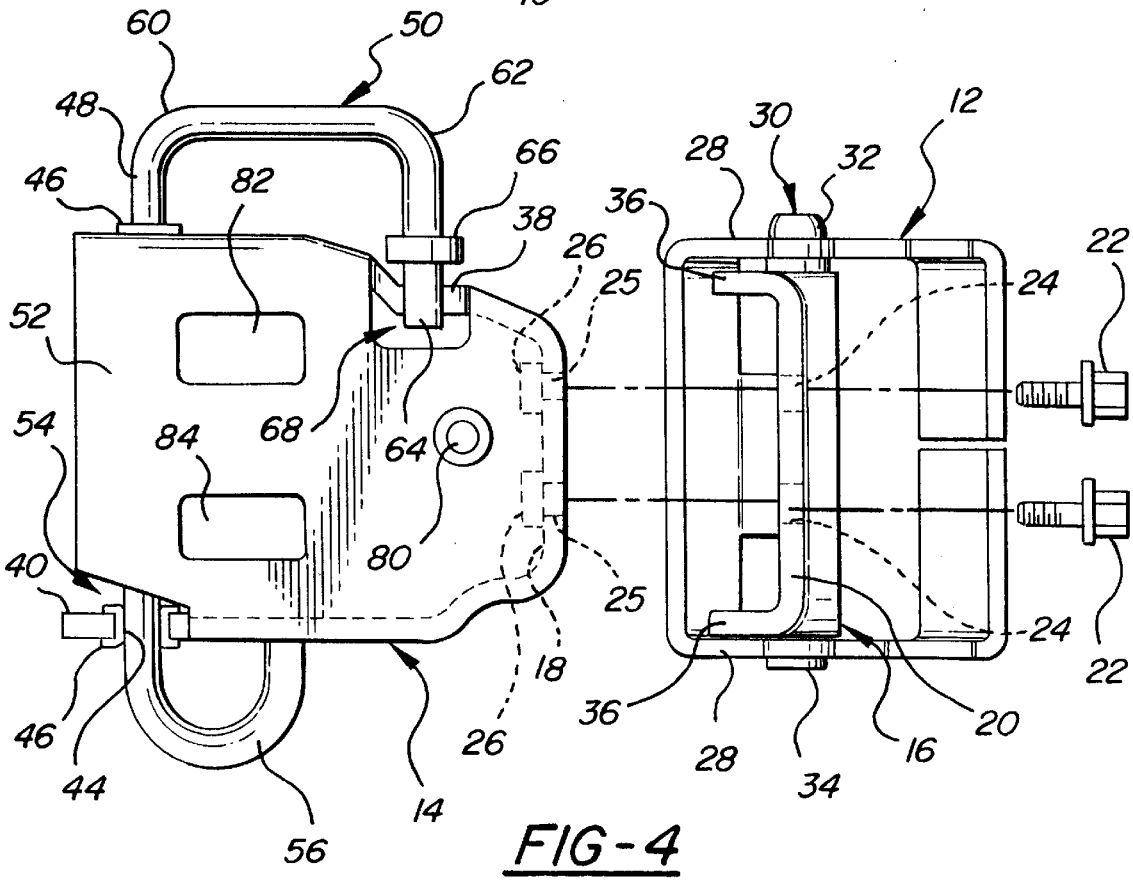
FIG-4

CONSTANT CONTACT HINGE ASSEMBLY

BACKGROUND OF THE INVENTION

1. Field of the Invention

This invention relates to an automotive door hinge, and, more particularly, this invention relates to an automotive door hinge providing door-off assembly and three position detent action at a closed position, partially open position and a fully opened position.

1. State of the Prior Art

A wide variety of automotive door hinges are available, with a current popular version being of the type to provide doors-off assembly of the vehicle. A first hinge frame member is bolted to a body portion of the vehicle, and a second hinge frame member is aligned and mounted to the door, usually using threaded fasteners. The hinge is then taken apart so that further assembly and finishing can be accomplished separately for the car body and the door.

To facilitate taking the hinge apart while maintaining the hinge alignment accuracy and to eliminate the involvement of handling loose parts, the hinge is not disassembled or taken apart at the hinge pin, but rather parts are unbolted or unscrewed. This requires the use of an intermediate swinging member which is journalled on the hinge pin with the hinge pin being attached to one of the first and second hinge frame members, usually the first, body, hinge frame member. The intermediate swinging member is bolted to the other hinge frame member usually the second door frame hinge member.

The hinge must provide a detent action requiring force to be applied to the door to move it from a closed door position to an open door position and from an open door position to a closed door position. Usually an intermediate, partially open, door position is also specified. This requires the assembly of separate detent elements such as fingers, stops, cam wheels and followers and the like to one or both of the hinge frame members. This in turn results in an uneven, noisy, sometimes "click-click" hinge action when the door is moved from its closed detent position, partially open detent position and fully open detent position.

SUMMARY OF THE INVENTION

The hinge of the present invention retains the advantages of the prior art take-apart hinges using an intermediate swinging hinge member which is rotationally connected to one of two hinge frame members by a hinge pin and is detachably attached to the other of the two hinge members by take-apart fasteners.

The reliability of a torsion spring to provide detent force is also retained.

Added to the reliable old portion of the hinge is a new cam. The cam has a closed door detent, a partially open door detent and a fully open door detent as an integral part of a cam surface. The cam surface has a smooth continuous contour between the detent positions.

A new cam follower is kept in constant contact with the cam surface by the torsion spring. As the door is moved by the driver or passenger, a smooth, even and quiet action results with positive holding at the detent positions.

Gone are the previous separate detent elements and the undesirable noise.

The new automotive door hinge provides door-off assembly and three position detent action. In a preferred embodiment, the hinge includes a first body frame member which has a pair of spaced horizontally extending flanges with a hinge pin mounted between the flanges. A swinging member has a pair of spaced horizontally extending ears that are journalled on the hinge pin for rotation of swinging member relative to the body frame member. A second door frame member is detachably attached to the swinging member by conventional fasteners. The door frame member will thus rotate with the swinging member relative to the body frame member about the hinge pin. The torsion spring is mounted on the body frame member to apply force to the door frame member. The cam in one preferred embodiment, is an integral part of the door bracket and a cam follower is mounted on the torsion spring and held by the spring against the cam surface.

DRAWING

The advantages of the present invention will be more apparent from the following detailed description when considered in connection with the accompanying drawings wherein:

FIG. 3 is a rear elevational view; and

FIG. 4 is an exploded front elevational view.

DETAILED DESCRIPTION OF A PREFERRED EMBODIMENT OF THE INVENTION

Figure 1:
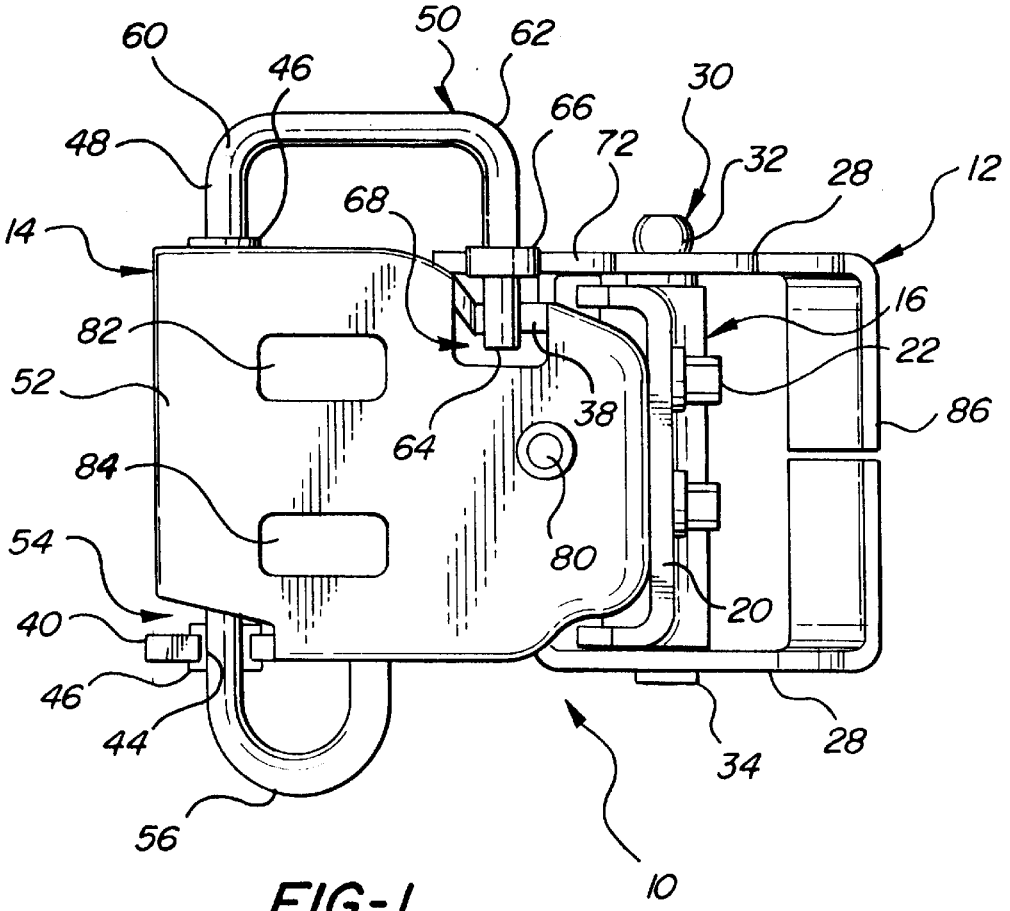
FIG. 1 is a front elevational view of the hinge of this invention.

As best seen in FIGS. 1 and 4, the automotive door hinge 10 of this invention includes three frame members: a door bracket member 12, a body bracket 14 and an intermediate swinging frame member 16. The body bracket 14 and the swinging frame member 16 have vertical flanges 18 and 20 respectively which are detachably attached together by bolts 22 which pass through holes 24 in flange 20 of the swinging frame member 16 and holes 25 in flange 18 of the body bracket 14 and are retained by the nuts 26 welded to flange 18 on the body bracket 14.

The door bracket 12 has a pair of horizontally extending flanges 28 between which the hinge pin 30 is located. The intermediate swinging frame 16 has a pair of spaced horizontally extending ears 36 which are journalled on the hinge pin 30 between the flanges 28. The hinge pin is permanently affixed to the door bracket by hinge pin head 32 and peened over or staked end 34 acting against the flanges 28. Obviously because of their attachment the intermediate hinge frame member 16 and the body bracket 14 swing as a single unit on the hinge pin 30 relative to the stationary door bracket 12.

The body bracket 14 has a pair of spaced horizontally extending flanges 38 and 40 having slots 42 and 44 respectively which receive bearing inserts 46 to hold a vertical extent 48 of torsion spring 50. The flange 40 and a plate portion 52 of the body bracket 14 is cut away at 54 so that the slot 44 in flange 40 can open facing toward plate portion 52 while the slot 42 in flange 38 opens facing away from plate portion 52 to permit the spring loading forces to act against the flanges 38 and 40 without dislodging the spring from the slots; compare FIGS. 1 and 4 to FIG. 3.

The lower end of torsion spring 50 has a 180° turn 56 from its vertical extent 48 to a free upwardly extending end 58 which bears against lower flange 40; see FIG. 3.

The upper end of torsion spring 50 has 90° bends at 60 and 62 and terminates in a downwardly extending free end at 64. A cylindrical cam follower 66 is attached to the spring 50 adjacent its free end 64. The plate portion 52 of the body bracket 14 and a portion of flange 38 is cut away at 68 to allow lateral movement of the free end 64 of the spring without hitting the flange 38; see FIGS. 1 and 3.

The plate portion 52 of the body bracket 14 is provided with a threaded boss 80 and slots 82 and 84 for fastener mounting to the automotive body, the slots 82 and 84 permitting alignment adjustment.

Figure 2:
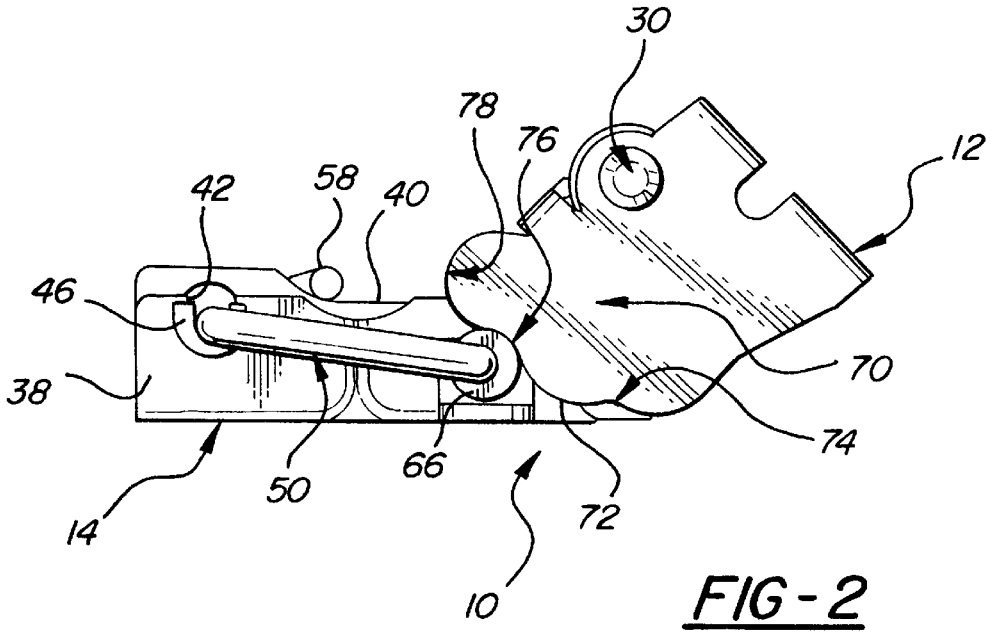
FIG. 2 is a top plan view showing the hinge in a partially open position.

One of the horizontal flanges 28 of the door bracket 12, shown in the drawing FIGS. as the upper flange, is formed as a cam 70 having a continuous curved vertically extending cam surface 72 against which the cam follower 66 rides. The cam surface has detents defined at 74, 76 and 78 as seen in FIG. 2 for holding the attached car door, not shown, in its closed, partially opened and fully opened positions respectively. The hinge is shown in FIG. 2 being held in its partially open position. It will be appreciated that the cam 76 can be on a lower or upper flange 28 depending on whether the hinge 10 is for a right hand or left hand door. Likewise, the cam follower 66 can be on a downwardly extending free end portion 64 of the torsion spring 50 or on an upwardly extending free end portion of the spring 50.

The door bracket has a vertically extending flange 86 which is welded to the automobile body.

In the doors-off assembly of the hinge 10 to a vehicle, the hinge is in its fully assembled condition with hinge pin 30 staked in place joining door bracket 12 to the intermediate hinge member 16. and the intermediate frame member 16 is attached to the body bracket by bolts 22.

Flange 86 of the door bracket 12 is first welded to the door. The body bracket 14 is then attached to the door by a threaded fastener being screwed into the threaded boss 80 and other fasteners passing through slots 82 and 84. The automobile door is aligned in this process.

Once alignment has been completed, the hinge 10 is taken apart by removal of bolts 22. This allows the door to be separately finished from the body. With the permanent mounting of the hinge pin 30 to the door bracket and intermediate frame members and the mounting of the torsion spring to the body bracket the hinge may be disassembled without loss of the various detent components.

When the separate finishing of the car door and body are completed, the door is reattached to the body by bolting the door bracket 12 to the intermediate frame member 16. The door retains its prealigned condition.

With the detent hinge action being provided by the cam and follower the hinge can be customized for particular vehicles and vehicle models by simply changing this cam portion so that only different door brackets have to be stocked, greatly simplifying tooling, inventory and general handling. Prior art hinge design required a completely different hinge for each application.

We claim:

1. An automotive door hinge providing door-off assembly and three position detent action at a closed position, partially open position and fully open position, said hinge comprising:

a first frame member having a pair of spaced horizontally extending flanges with a hinge pin mounted between said flanges;

a swinging member having a pair of spaced horizontally extending ears journalled on said hinge pin for rotation of said swinging member relative to said first frame member;

a second frame member detachably attached to said swinging member for rotation with said swinging member relative to said first frame member about said hinge pin;

a torsion spring mounted on one of said first and second frame members;

a detent holding mechanism operable between said first and second frame members comprising:

a cam located on an other of said first and second frame members, said cam having a smooth continuous cam surface between a closed door position detent on said cam surface and a partially open door position detent on said cam surface, and said cam having a smooth continuous cam surface between said partially open door position detent and a fully open door position detent on said cam surface; and a cam follower mounted on said torsion spring, said cam follower being held in constant contact against one of said smooth continuous cam surfaces by said torsion spring for continuous movement along one of said smooth continuous cam 23 surfaces between detent positions.

2. The hinge according to claim 1 wherein said first frame member is a door bracket to be mounted on an automotive door and said second frame member is a body bracket to be mounted on an automotive body.

3. The hinge according to claim 2 wherein said second member has a pair of spaced, horizontally extending flanges retaining an intermediate vertically extending portion of said torsion spring therebetween, and said cam follower is mounted adjacent a vertically extending free end of said torsion spring.

4. The hinge according to claim 3 wherein said cam is located on one of said flanges of said first door bracket member.

5. In an automotive door hinge configured for doors-off assembly of a door to a vehicle, the hinge comprising a first frame member mounted to the vehicle, the first frame member having a pair of spaced horizontally extending flanges with a hinge pin mounted between said flanges; a swinging member having a pair of spaced horizontally extending ears journalled on said hinge pin for rotation of said swinging member relative to said first frame member; a second frame member detachably attached to said swinging member for rotation with said swinging member relative to said first frame member about said hinge pin, said second frame member being mountable to said door and having a pair of spaced horizontally extending flanges retaining a vertically extending portion of a torsion spring therebetween; one of said flanges of said first frame member being configured as a cam having a cam surface; and, a cam follower mounted adjacent a free end of said torsion spring, the improvement comprising:

said cam follower being held in constant contact with said cam surface by said torsion spring at all times during the operation of said hinge, and said cam surface being configured as a smooth, continuous surface so that, as said cam follower moves continuously there along, the door will move smoothly from a closed door position to a partially open door position and from said partially open door position to a fully open door position.

* * * * *